United States Patent [19]

Nelms

[11] 4,200,774

[45] Apr. 29, 1980

[54] KEY-OPERATED ELECTRICAL SWITCH ASSEMBLY

[76] Inventor: David E. Nelms, 6454 Lexleigh Rd., Reynoldsburg, Ohio 43068

[21] Appl. No.: 935,517

[22] Filed: Aug. 21, 1978

[51] Int. Cl.[2] ..... H01H 9/28; H01H 27/06

[52] U.S. Cl. ..... 200/44; 74/103

[58] Field of Search ..... 200/42 R, 44, 42 T; 74/100 R, 102, 103, 100 P, 101, 104, 105, 106, 107, 108, 109

[56] References Cited

U.S. PATENT DOCUMENTS 3,618,409 11/1971 Shifley ..... 74/102

*Primary Examiner*—Houston S. Bell, Jr.
*Attorney, Agent, or Firm*—Robert E. Stebens

[57] ABSTRACT

A key-operated electrical switch assembly is provided and is designed primarily to be used in conjunction with the electrical system of an automobile or truck as a means to provide a source of electric power. This assembly was devised primarily for use with alternator powered electrical systems, as are now utilized in most automotive vehicles. Furthermore, it is designed and constructed in such a manner that the assembly could not be left in an "on" position if one desired to retain the security of the key. This switch assembly includes an insulated plastic enclosed structural support frame, consisting of a rectangular base upon which the switch is mounted, the switch assembly, which is made operative by a coupling means effectuated by a longitudinal actuating plate and controlled by a perpendicular projecting pin which transverses rectilinearly along a longitudinal tract located above the actuating plate, said tract containing a lock bolt attached to the projecting pin; and a key-operated lock device which controls the rectilinear movement of the lock bolt. A universal mounting bracket and a switch cover are also components of the switch assembly. This invention is capable of providing for a minimum power output of at least 20 amperes.

9 Claims, 5 Drawing Figures

KEY-OPERATED ELECTRICAL SWITCH ASSEMBLY

BACKGROUND OF THE INVENTION

This invention is intended primarily for use as an aid to emergency and relief efforts by harnessing the power of an automobile's or truck's electrical system and converting it into immediate and useful electrical power for tools, machines, and other appropriate devices, thereby reducing dependence on much larger, heavier, and considerably more expensive independently operated electrical generators currently in use.

Other key-operated electrical switch assemblies exist but they are based on cam or rotary movement. Such assemblies have been subject to improvements over the past few decades but all have continued to be based on rotary principles. This device is new and unique in that it relies on rectilinear motion as a means to facilitate operation. No switching device prior to this time has utilized rectilinear motion to mechanically actuate the electrical contacts.

Furthermore, rotary devices due to their structural arrangement and functional operation have heretofore required a greater volume of mounting space than is required by the rectilinear type device of this invention capable of generating the same amount of power. This greater degree of economics with respect to space is translated financially into decreased costs for the manufacturer. Also there is more utility to be had from this assembly since, because of its smaller size it can be used for a greater variety of purposes than can the relatively larger rotary-type switch assemblies. This device requires a relatively minimal thickness dimension due to the unique rectilinear operation, whereas existing rotary-type assemblies necessitate a substantially larger overall structure in which to operate.

Prior key-controlled electrical switch assemblies exist which utilize rectilinear motion. However, in those systems the function of the rectilinear motion was to serve as a protective lock on the assembly. In those systems the electrical system was never actuated by means of rectilinear motion produced by a keylock device. Instead the function of the lock was to prevent operation of the assembly by unauthorized individuals. In accordance with this invention, the key actually effects the operation of the entire assembly, by actuating operation of the device.

The prior key-controlled assemblies distinguishable from the assembly provided by this present invention are those by Cook, U.S. Pat. No. 1,444,664 and Kaisling, U.S. Pat. No. 1,293,794. The Cook device employed the locking device as a means to prevent unauthorized use of an ignition control switch. The key-controlled element in no way actuated the switch assembly. Its function was to deter auto theft. However, this key-operated electrical switch assembly is not concerned with preventing theft, but in providing a means to effectively control the associated circuitry to transfer the energy from an alternator powered electrical system to appropriate electrically energized equipment external to an automotive vehicle. The Kaisling device also utilizes a key-controlled switch but the lock serves only as a means to prevent movement of manually operated plungers which serve to actuate the switch assembly. Once again the function of the key-controlled mechanism was not to actuate the switch assembly, in and of itself, as is the case with this present invention. Neither of the above devices functioned to actuate the switch assembly by means of a key. The state of the prior art was such that rectilinear motion was not used as a means of actuating key-operated electrical systems. This invention possesses substantial differences between both previously known rotary operated switch assemblies and rectilinear key-controlled devices to such an extent that it represents an advancement in key-actuated electrical switch art.

It is the object of this invention to provide a key-operated electrical switch assembly designed to be of use in times of emergency or natural disaster by means of the incorporation of a self-latching feature that enables the assembly, when properly connected to the electrical system of an automobile or truck, to serve as a switch assembly capable of transferring power to operate electrical equipment usually associated with emergency and relief efforts.

An additional object is to provide a key-operated electrical switch assembly that by virtue of its operation by means of rectilinear motion is more economical to produce than existing rotary or cam-operated devices.

Another object of the invention is to provide a key-operated electrical switch assembly that is small in size, said assembly occupying minimal amount of space between the base and top of the device as a result of the means of operation which incorporates rectilinear, as opposed to rotary, motion.

Still another object of the invention is to provide a key-operated electrical switch assembly by means of a key, as opposed to an assembly that features the protective locking of a rectilinear electrical system by means of a key.

Yet another object is to actuate a plurality of switches by means of a key, with the primary function of these switches being to connect the electrical plug outlets located on the upper elongated planar plate of the assembly into a control circuit, and also to effect control of that circuitry.

The above and still further features, objects and advantages of the present invention will become apparent upon consideration of the following detailed description of a specific embodiment thereof. Reference will be had to the accompanying drawings which illustrate the embodiment of the invention.

DESCRIPTION OF THE DRAWING FIGURES

DESCRIPTION OF THE ILLUSTRATIVE EMBODIMENT

Figure 1:
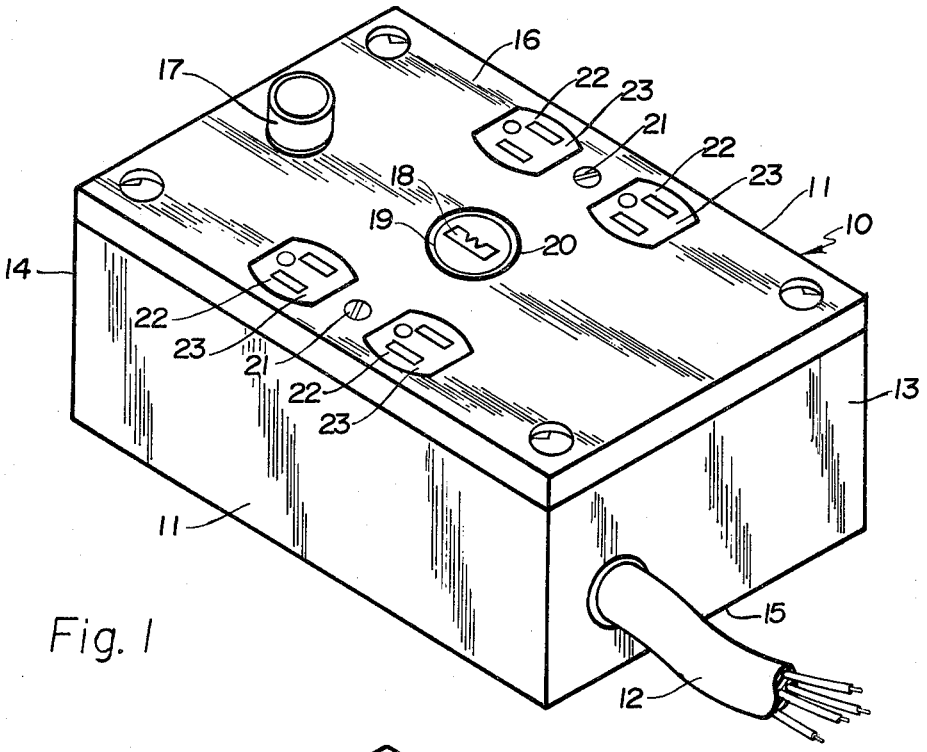
FIG. 1 is a front perspective view of a switch assembly structure embodying this invention but omitting the handle and the switch cover.

Having reference to the drawings, attention is directed to FIG. 1 which illustrates a key-operated electrical switch assembly structure designated generally by the numeral 10 and comprising a structural housing. The plastic structural housing has an open-topped bottom section having side walls consisting of two rectangular planar side plates 11, a rectangular planar end plate 13 with a circular opening, a rectangular planar end plate 14, and a rectangular planar base plate 15. This structural housing is provided with a top cover that is a rectangular planar plate 16. In this embodiment, the several plates of the bottom section are integrally formed from a suitable material by appropriate stamping or molding operations as is the top cover. Mechanical assembly of the bottom section and top cover can be readily effected by appropriate fastening elements. Extending from the inside of the switch assembly structure 10 is an electric cable 12. This electric cable 12 contains four wires for use in attachment to the switch terminals 26 which are shown in FIG. 2.

Figure 2:
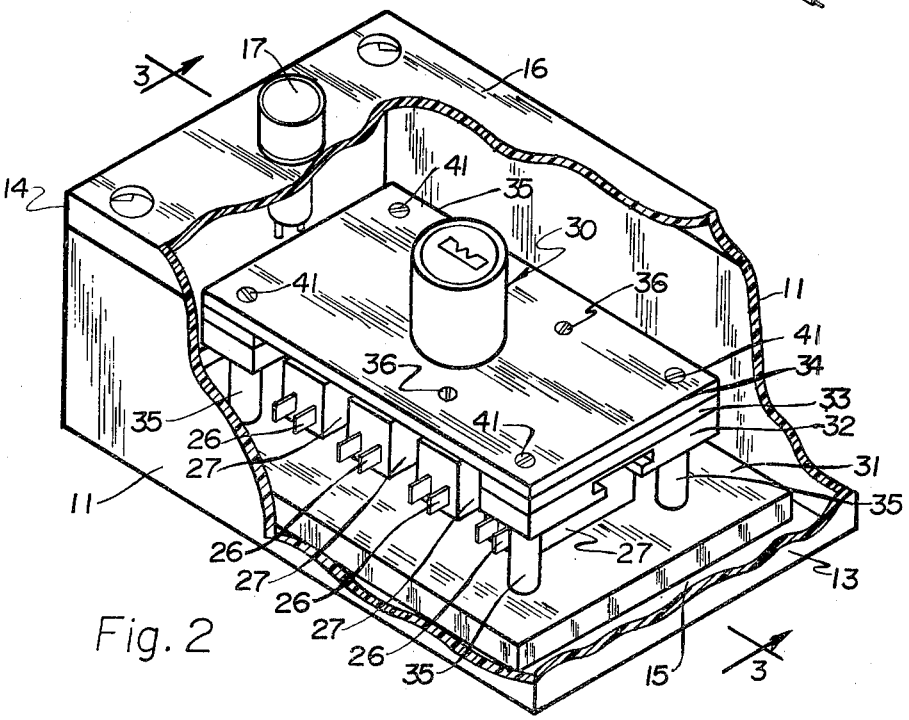
FIG. 2 is a front perspective view partially omitting the outer frame, thereby disclosing the actual switch assembly contained therein.

Further examination of FIGS. 1 and 2 illustrates that projecting through the rectangular planar top plate 16 at the opposite end of the switch assembly structure 10 from the rectangular planar end plate 13 with the circular opening is a conventional cylindrical fuse 17. The fuse 17 possesses a plug which can be attached to wires running from the individual switch terminal 26 used to transfer electrical power to two conventional three-pronged electrical plug outlets 23 which are longitudinally mounted to the planar top plate 16 by means of screws 21. The two conventional plug outlets each incorporate two individual plug outlets 22. The remaining switches 27 are utilized as connections for any necessary by-pass circuits within the alternator powered electrical system. The switch terminal 26 is connected to the electrical plug outlets 23 by appropriate electrical conductors (not shown). A cable which would be capable of extending a limited distance from the assembly structure 10 could, if desired, be connected to these outlets. The use of such a cable would provide greater flexibility as to where the switch assembly could be utilized.

Figure 5:
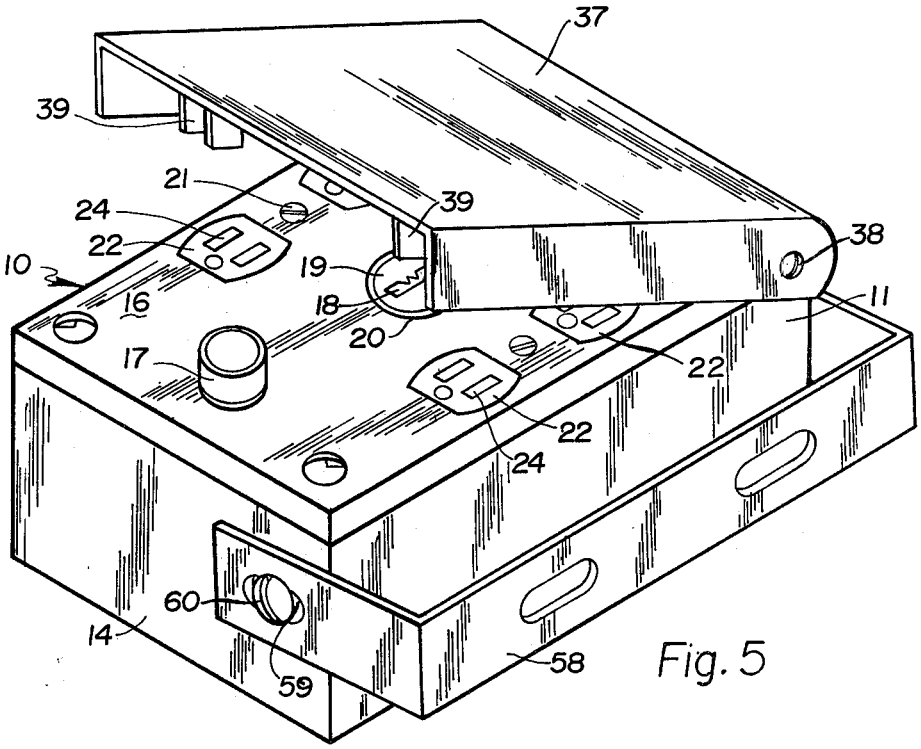
FIG. 5 is a rear perspective view of the switch assembly structure embodying this invention.

Referring to FIG. 5 the switch assembly 10 is shown with the mounting 58 and switch cover 37 attached. The mounting bracket 58 permits mounting of the device by the use of openings along the longitudinal portion of the bracket which allow for the device to be fastened to other objects. The bracket opening 59 permits a screw 60 to fasten the bracket to the structural housing of the switch assembly on the end plate 14 and the end plate with circular opening 13. The shape of the bracket opening 59 is such that it allows the bracket 58 to be adjustable with respect to the distance between the longitudinal plane of the mounting bracket 58 and the side plate 11.

The plastic switch cover 37 attaches to the structural housing of the switch assembly by means of screws 38 which fasten the cover 37 to the side plate 11. The attachment is such that the cover can be rotated about the axis of the screws 38 by lifing the cover along the edge where the word "Lift" is printed. On the underside of the cover are two plastic plugs 39. When the cover 37 is closed the plugs 39 friction fit into the two individual plug openings 24 thereby providing adequate closure of the cover. When closed, the cover prevents utilization of the individual plug outlets 22. When the cover is lifted the plastic plugs no longer occupy the individual plug openings 24, thereby allowing utilization of all the individual plug outlets 22.

Another feature of this switch assembly concerns the amount of electrical power which is capable of being immediately transferred. Through the incorporation of a standard fuse and switches, power can be provided in the area of 20 amperes. However, by the utilization of fuses and switches of greater current handling capability power transfer capabilities could foreseeably be provided in the region of 100 amperes or more. Such capability would allow for a greater scope of use, especially in conjunction with industrial tools and machines.

Figure 3:
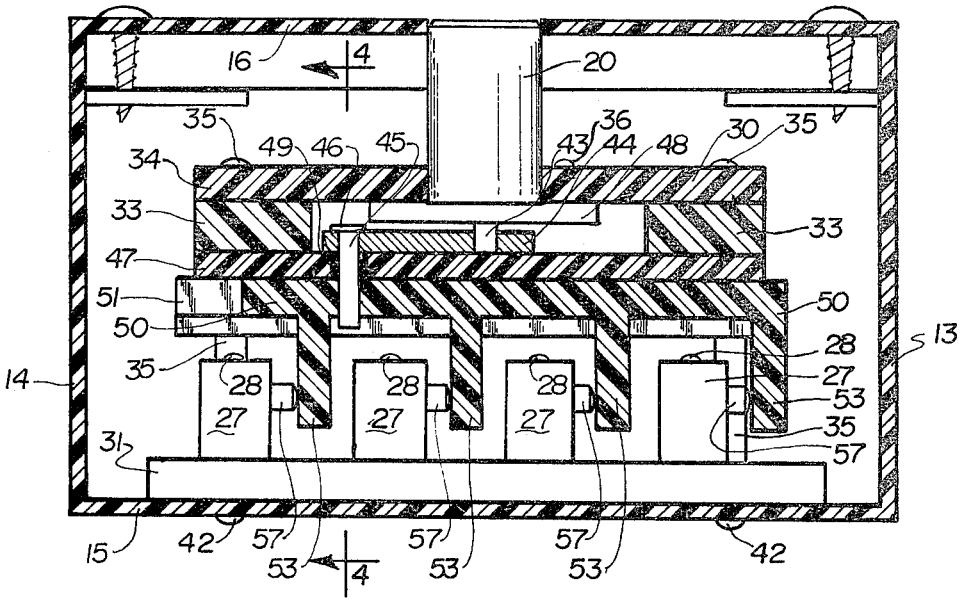
FIG. 3 is a vertical sectional view taken along line 3—3 of FIG. 2.
Figure 4:
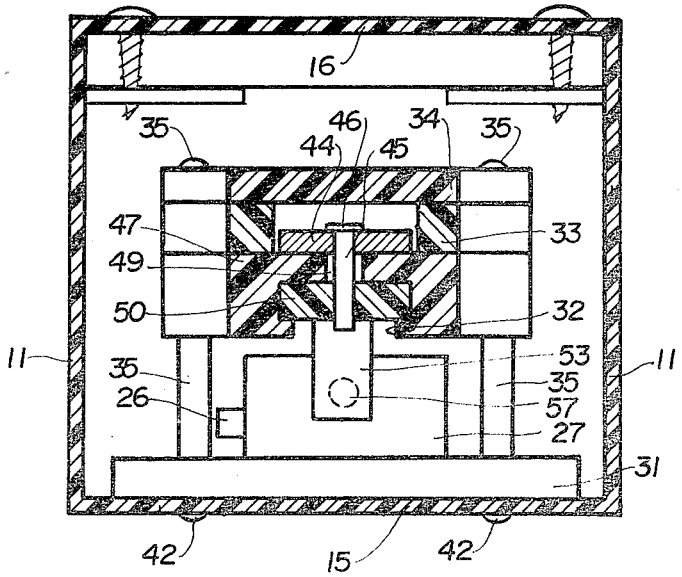
FIG. 4 is a vertical sectional view taken along line 4—4 of FIG. 3.

Referring to FIGS. 2, 3 and 4, the actual switch assembly 30 is seen mouted on the rectangular planar base plate 15 with the aid of screws 42, which fasten the planar base plate 15, an elongated plastic base plate 31, and support mounts 35. Attached directly to this elongated plastic base plate 31 along its longitudinal axis are the four switches 27. These switches are fastened to the elongated plastic base plate 31 by means of screws 28 as can also be seen in FIG. 3. A coupling means whose structure will be discussed later, serves to actuate the switches for the assembly. This coupling means is situated above the switches 27 through the use of support mounts 35, which are perpendicular to the plastic base plate 31. These mounts 35 allow for the passage of a screw 41 which fastens the key-operated lock device and the coupling means to the upper end of the support mounts. These mounts 35 are also preferably plastic to insure effective electrical insulation. Each switch 27 makes use of a switch actuating element 57 which is spring biased to an extended position. This actuating element 57 is in contact with a lateral projection of the actuating plate 53, comprising part of the coupling means.

Also shown on the surface of the planar top plate 16 at the mid-point of the longitudinal axis of said plate is the end portion of a key-operated lock device, having a lock mounting barrel 20, containing a lock cylinder 19 selectively rotatable in the lock barrel about a cylinder axis by means of a key. This key is selectively inserted in the key opening 18 in order to actuate the switch assembly designated generally as 30. The lock device if preferably constructed in such a manner that by turning the key through an angle of 90° would effectuate a self-latching process thus eliminating the need for constant supervision of the key in order to maintain the operation of the switch assembly 39 once actuated. In addition, this self-latching feature serves the purpose of necessitating the cessation of the operation of the invention if the operator desires to retain the security of the key. This safety feature would held to minimize potential electrically related accidents.

At the lower extremity of the lock cylinder 19 is a lock pin 43. The lock pin 43 protrudes slightly from an opening in the lock mount 48 through which it passes. This lock pin 43 which occupies a position near the vertical axis of the lock cylinder 19, extends from the central portion of the lock cylinder. The lock mount 48 is welded to the lock mounting barrel 20. The lock mount is also attached to the plastic lock mounting plate 34 by means of screws 36. The lock mount is constructed in such a manner as to allow for the longitudinal movement of the lock pin 43 a distance of about 0.25 centimeter from the rest position of the pin 43, and thence in a direction towards the rest position of the actuating pin 45. These rest positions are both shown in FIG. 3. The lock pin 43 projects vertically downward into the lock bolt 44. The lock bolt 44 rests on an elongated planar plate 47. Located at the far end of the lock bolt 44 is the actuating pin 45. This actuating pin 45 is attached to the lock bolt 44 by means of a fastener 46. The lock mount 48 and lock bolt 44 are situated within the lock belt guideway 33. This preferably plastic lock bolt guideway 33 surrounds the lock mount 48 and lock bolt 44 to the extent that only the rectilinear longitudinal movement of the lock bolt 44 is possible.

A coupling means comprising the actuating pin 45, the actuating plate 50 and the vertical projection 53 of the actuating plate is visible in FIGS. 3 and 4. The actuating pin 45 is positioned on the longitudinal axis of the lock bolt 44. The actuating pin 45 extends vertically downwards where it contacts the vertical surface of the actuating plate 50. A small slotted opening exits for the actuating pin 45. This slotted opening needs to be only slightly greater than 0.25 centimeter to provide for the longitudinal movement of the actuating pin 45 when the switch assembly system is operating. The actuating plate 50 moves rectilinearly within a guideway 32 having a T-shaped cross section. The upper longitudinal surface of the component comprising the guideway 32 also serves as the elongated planar plate 47 on which the lock bolt 44 moves. The actuating plate 50 is provided with an opening 51 to move into when the assembly is in operation. Projecting vertically downwards from the actuating plate 50 is a vertical projection 53. This vertical projection 53 makes surface contact with the switch actuating element 57.

A brief summary of the operation of the invention follows. Functional operation of the key-operated electrical switch assembly commences when the proper key is inserted in the key opening 18 of the lock cylinder 19. When the key is rotated 90° the lock mechanism is such that it effects a translation of the rotary movement of the lock cylinder 19 into rectilinear movement of the lock pin 43. As the lock pin 43 moves rectilinearly it displaces the lock bolt 44 longitudinally along the lock bolt guideway 33. Similarly the movement of the lock bolt 44 effects the simultaneous displacement of the actuating pin 45. The actuating pin 45 also effects the simultaneous rectilinear displacement of the actuating plate 50 as it moves within its guideway 32. As the actuating plate 50 moves longitudinally the vertical projections of the actuating plate 50 which previously have been in surface contact with the individual switch actuating elements 57 depress the spring biased actuating elements 57. The actuating element 57 has only two selectively displaceable positions which depend on whether the assembly is in the "on" or "off" position. In the "off" position the element 57 is as shown in FIG. 4. However, when the vertical projections 53 depress the actuating elements 57, the switch 27 is activated thereby providing a means for the immediate use of the power from the alternator powered electrical system, to which the key-operated electrical switch assembly is connected.

It will be readily apparent, from the foregoing detailed description of illustrative embodiments of this invention, that a particularly novel and extremely useful electrical switch assembly is provided. The structure would provide for the simultaneous operation of four switches, capable of being used to transfer power for immediate use in the operation of various electrically powered devices, especially in times of an emergency or a natural disaster.

Having thus described this invention, what is claimed is:

1. A key-operated electrical switch assembly comprising a structural support frame including an elongated planar top plate having a longitudinal axis in the plane of said plate, an electrical switch mounted in fixed relationship on said structural frame and having an actuating element selectively displaceable between first and second positions, a key-operated lock device having a mounting barrel, a lock cylinder selectively rotatable in said barrel about a cylinder axis by means of a key selectively insertable in said lock cylinder and a lock bolt, said barrel fixedly mounted on said planar top plate with the lock cylinder axis perpendicular thereto, said lock cylinder and lock bolt having a mechanical coupling means for directly effecting a translation of horizontal rotary movement of the vertical lock cylinder to rectilinear displacement of said lock bolt along the longitudinal axis of said planar top plate, said rectilinear displacement occuring in a horizontal plane perpendicular to the vertical plane associated with the lock cylinder, and coupling means interposed between said lock bolt and the actuating elements of said electrical switch to affect operation of said switch.

2. A switch assembly according to claim 1 wherein said electrical switch includes an actuating element, said actuating element being spring biased to said first position.

3. A switch assembly according to claim 1 wherein said structural frame supports a plurality of switches, said switches are all actuated simultaneously by means of the rotation of the selectively insertable key by said coupling means.

4. A switch assembly according to claim 1 wherein said coupling means includes an actuating plate supported for reciprocating rectilinear movement in parallel relationship to the longitudinal axis of movement of said lock bolt, an actuating pin mechanically coupling said lock bolt with said actuating plate, and a projection carried by said actuating plate and extending into operative coupling relationship to said electrical switch actuating element.

5. A switch assembly according to claim 4 wherein said coupling means includes an elongated guideway for cooperatively receiving said actuating plate for support thereof in the rectilinear displacement, said guideway having an elongated slot extending longitudinally thereof, said actuating plate is an elongated bar having the projection formed thereon in longitudinally spaced relationship and extending outwardly through said guideway slot.

6. A switch assembly according to claim 4 wherein said coupling means includes an elongated guideway for cooperatively receiving said actuating plate for support thereof, said guideway having a T-shaped cross-section.

7. A switch assembly according to claim 4 wherein said coupling means includes an elongated guideway for cooperatively receiving said lock bolt for support thereof in the rectilinear displacement, said guideway located above and parallel to, but spaced from the guideway for the actuating plate.

8. A switch assembly according to claim 7 wherein said coupling means includes an elongated planar plate, said plate located between the guideway for the lock bolt and the guideway for the actuating plate, the upper surface of the elongated plate providing support thereon for the lock bolt.

9. A switch assembly according to claim 8 wherein said elongated planar plate has an elongated slot through which said actuating pin passes.

* * * * *